US009395144B1

(12) United States Patent
LoRocco et al.

(10) Patent No.: US 9,395,144 B1
(45) Date of Patent: Jul. 19, 2016

(54) BOWSTRING RELEASE DEVICE

(71) Applicant: TruGlo, Inc., Richardson, TX (US)

(72) Inventors: Paul LoRocco, Dallas, TX (US); John Estridge, Plano, TX (US); Damon Lamont Coalson, Dallas, TX (US)

(73) Assignee: TruGlo, Inc., Richardson, TX (US)

( * ) Notice: Subject to any disclaimer, the term of this patent is extended or adjusted under 35 U.S.C. 154(b) by 260 days.

(21) Appl. No.: 13/949,692

(22) Filed: Jul. 24, 2013

Related U.S. Application Data

(63) Continuation of application No. 13/589,041, filed on Aug. 17, 2012, now Pat. No. 8,522,764.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469; F41B 5/1411
See application file for complete search history.

(56) References Cited

U.S. PATENT DOCUMENTS

| | | | | |
|---|---|---|---|---|
| 4,403,594 | A | 9/1983 | Todd | |
| 4,625,705 | A | 12/1986 | Willits | |
| 5,307,788 | A | 5/1994 | Peck | |
| 5,357,939 | A | 10/1994 | Tentler et al. | |
| 5,448,983 | A | 9/1995 | Scott | |
| 5,546,924 | A | 8/1996 | Todd | |
| 5,558,077 | A | 9/1996 | Linsmeyer | |
| 5,596,977 | A | 1/1997 | Scott | |
| 5,653,213 | A | 8/1997 | Linsmeyer | |
| 5,765,536 | A | 6/1998 | Scott | |
| 6,058,920 | A | 5/2000 | Tentler | |
| 6,478,020 | B1 * | 11/2002 | Rentz | 124/35.2 |
| 6,763,819 | B2 | 7/2004 | Eckert | |
| RE38,833 | E | 10/2005 | Linsmeyer | |
| 7,240,672 | B2 | 7/2007 | Peck et al. | |
| 7,314,045 | B2 | 1/2008 | Eckert et al. | |
| 2009/0056689 | A1 * | 3/2009 | Jones | 124/35.2 |

* cited by examiner

*Primary Examiner* — Melba Bumgarner
*Assistant Examiner* — Amir Klayman
(74) *Attorney, Agent, or Firm* — Alvin R. Wirthlin

(57) ABSTRACT

A bowstring release mechanism includes first and second jaws pivotally connected to a housing with a trigger section operably associated with the jaws for moving the jaws between open and closed positions. The jaws include opposing faces that are in a juxtaposed relationship when the release mechanism is in a closed position. Due to deviations in manufacturing tolerances and wear, a gap between the jaw faces may vary in size. To that end, an adjustment portion is operably associated with the trigger and jaws for precisely adjusting the size of the gap. A second adjustment portion for adjusting the sensitivity of the trigger section is also provided.

18 Claims, 10 Drawing Sheets

BOWSTRING RELEASE DEVICE

BACKGROUND OF THE INVENTION

This invention relates generally to archery accessories, and more particularly to a device for releasably holding a bowstring in a drawn position.

In the field of archery, and prior to the advent of the compound bow, bowstrings have been drawn by use of the fingers on the hand of the archer. In order to protect the fingers of the archer, leather protectors that covered the middle and forefingers of the drawing hand and wrapped around the wrist were provided. However, it is well known that manual release of the bowstring adversely affects the flight and accuracy of the arrow. With the advent of compound bows, more variables were introduced including lateral movement and increased draw forces, thereby making impractical the use of fingers for directly drawing the bow. Accordingly, several bowstring release devices have been proposed over the years.

Although such devices may be adequate, at least when newly manufactured, for permitting the draw and release of a bowstring to minimize potential injury to the archer and improve shooting accuracy, they are subject to wear, as well as unpredictable and cumulative manufacturing tolerances due to variations in the manufacturing process. The cumulative tolerance errors introduced into the assembly of the various parts of the bowstring release device can lead to assembled products that do not meet the minimum requirements for drawing and holding a bowstring under substantial pull forces. For example, a gap between juxtaposed faces of opposing jaws may become too large to properly hold the bowstring. In such an event, the assembly must be rejected, thus increasing manufacturing costs and labor for bowstring release devices that do pass the minimal manufacturing requirements. In addition, such devices may also become inoperative in the field due to wear caused by repeated use.

Accordingly, it would be desirable to provide an adjustable bowstring release assembly that overcomes at least some of the disadvantages of the prior art.

BRIEF SUMMARY OF THE INVENTION

According to one aspect of the invention, a bowstring release mechanism includes a housing, a first jaw with a first face operatively associated with the housing, and a second jaw with a second face operatively associated with the housing, the second face being disposed in juxtaposition with the first face. At least one of the jaws is movable with respect to the other of the jaws between closed and open positions for respectively retaining and releasing a bowstring. The release mechanism also includes a trigger section operatively associated with the housing and the at least one jaw for moving the at least one jaw between the closed and open positions, and an adjustment portion connected to the at least one jaw for adjusting a gap between the first and second faces.

According to a further aspect of the invention, a bowstring release assembly includes the bowstring release mechanism described above, and further includes an adjustable wrist strap for fitting around a wrist of a user, and an extension member having a first end pivotally connected to the adjustable wrist strap and a second end connected to the bowstring release mechanism.

According to yet another aspect of the invention, a bowstring release mechanism comprises a housing, a first jaw pivotally connected to the housing, the first jaw having a first face, and a second jaw pivotally connected to the housing, the second jaw having a second face disposed in juxtaposition with the first face. The faces of the first and second jaws are movable toward and away from each other between closed and open positions for respectively retaining and releasing a bowstring. The release mechanism also comprises a trigger section having an adjustment portion located in the housing and a lever portion extending out of the housing for manipulation by a user. The adjustment portion is pivotally connected to the first jaw for adjusting a gap between the first and second faces.

According to another aspect of the invention, a second adjustment portion can also be provided for adjusting the sensitivity of the trigger section.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
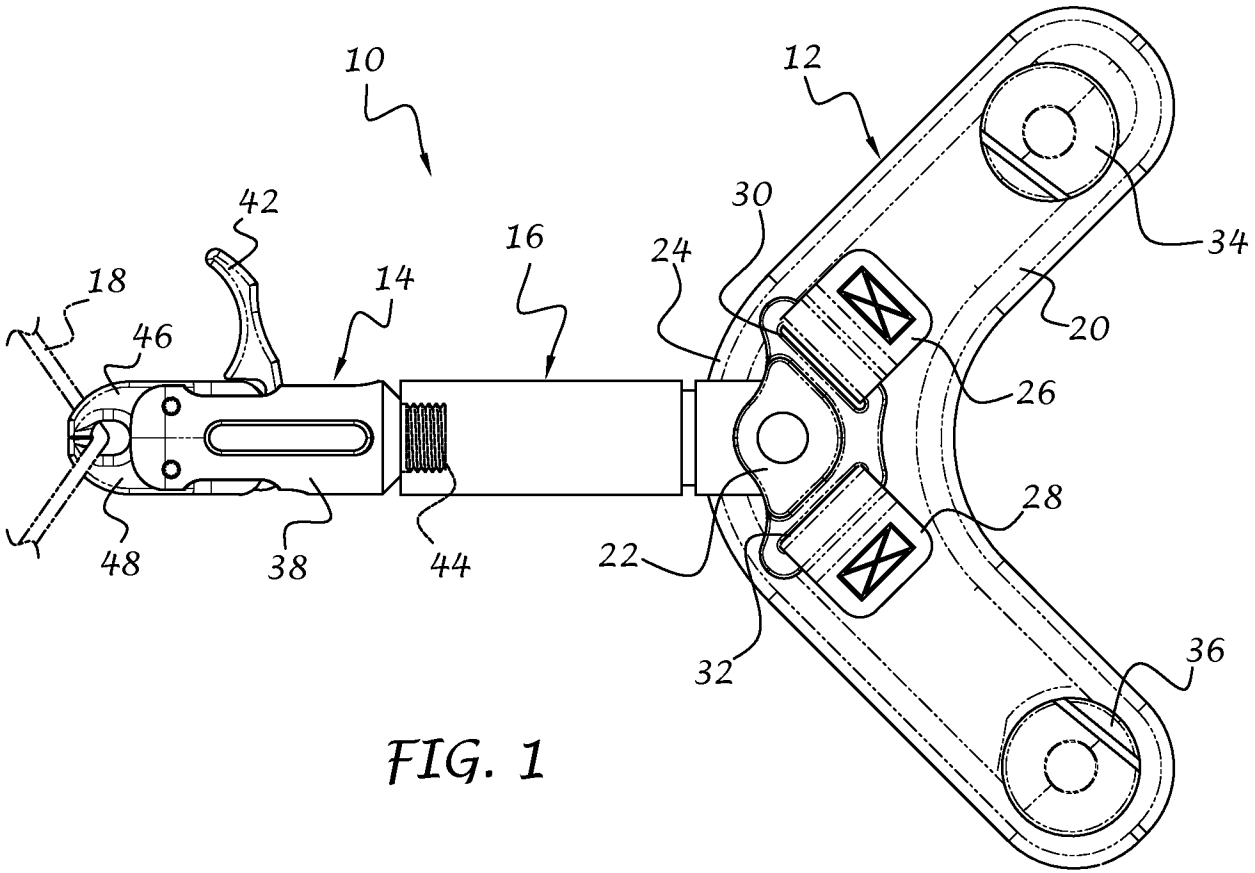
FIG. 1 is a top plan view of a bowstring release assembly in accordance with an exemplary embodiment of the invention.

Referring now to the drawings, and to FIG. 1 in particular, a bowstring release assembly 10 in accordance with the present invention is illustrated. The bowstring release assembly 10 preferably includes an adjustable wrist strap 12 and a release mechanism 14 connectable to the wrist strap via an extension member 16 for releasably engaging a bowstring 18 (shown in broken line in FIG. 1) and/or a conventional string loop or "D" loop (not shown) associated with the bowstring. The present invention is primarily adapted for use with compound bows due to the high pull forces that otherwise may injure the fingers of an archer, but may also be used with recurve bows, reflex bows, longbows, and so on.

The wrist strap 12 preferably includes a flexible V-shaped base member 20 that is adapted to at least partially surround the wrist when worn by an archer. A connecting member 22 is preferably attached to the apex 24 of the base member 20 via a pair of looped bands 26 and 28 that extend through slots 30 and 32, respectively, of the connecting member 22. The extension member 16 is preferably pivotally connected to the connecting member 22 to accommodate different hand shapes and sizes, as well as the preferences of individual archers for positioning the release mechanism 14 at a desired location with respect to the thumb and/or forefinger of an archer. A pair of anchor mechanisms 34 and 36 are connected to the flexible base member 20 and work together with a retractable cable (not shown) for cinching the wrist strap 12 around the wrist of a user. Further details of the wrist strap 12 can be found in copending U.S. application Ser. No. 13/314,330 filed on Dec. 8, 2011 and assigned to TruGlo, Inc., the disclosure of which is hereby incorporated by reference. It will be understood that the wrist strap 12 and extension member 16 can be of any suitable or conventional construction without departing from the spirit and scope of the invention.

Referring now to FIGS. 2-6, the release mechanism 14 preferably includes a housing 38, a jaw section 40 extending forwardly therefrom, a trigger section 42 positioned in the housing rearwardly of the jaw section and operable to manipulate the opening and closing of the jaw section, and a connecting section 44 that forms part of the housing and is located rearwardly of the trigger section for connection to an extension member 16 (FIG. 1) or the like.

The jaw section 40 preferably includes a first jaw 46 and second jaw 48 pivotally connected to the housing 38 via first and second pivot pins 50 and 52, respectively. The pivot pin 50 extends through an opening 54 (FIG. 4) formed in a first wall 56 of the housing 38, an opening 58 formed in the first jaw 46, and an opening 60 formed in a second wall 62 of the housing 38. Likewise, the pivot pin 52 extends through an opening 64 formed in the first wall 56 of the housing 38, an opening 66 formed in the second jaw 48, and an opening 68 formed in a second wall 62 of the housing 38. The pivot pins 50, 52 are preferably cylindrical in shape with grooved or fluted end portions 70 that are press-fit into their respective openings 54, 64 to prevent rotation of the pivot pins with respect to the housing. The openings 58 and 66 of the jaws 46 and 48, respectively, are preferably slightly larger in diameter than the pivot pins so that the jaws 46 and 48 freely pivot about their respective pins.

Figure 2:
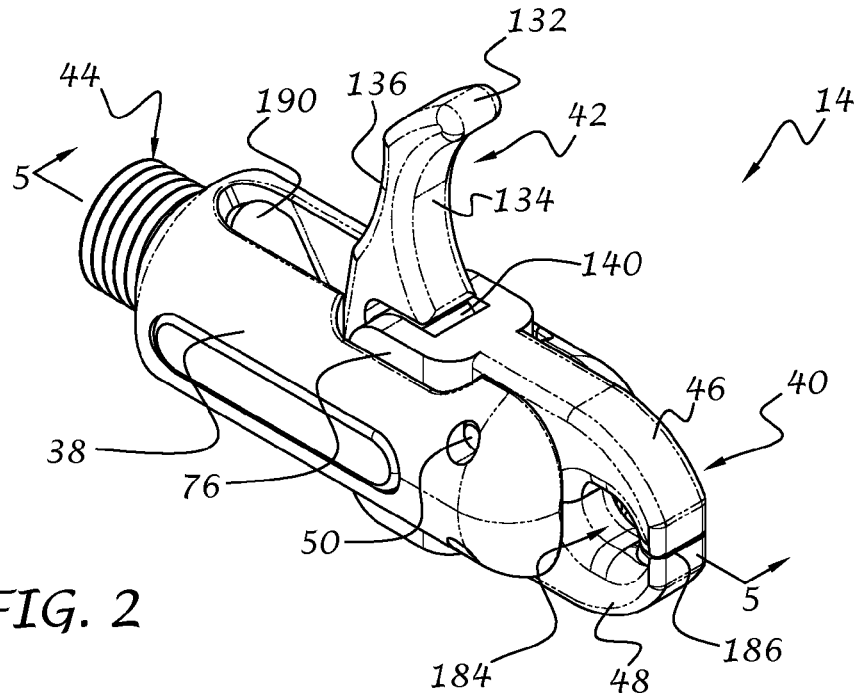
FIG. 2 is an isometric view of a bowstring release mechanism in accordance with the present invention in the closed position for holding a bowstring.
Figure 3:
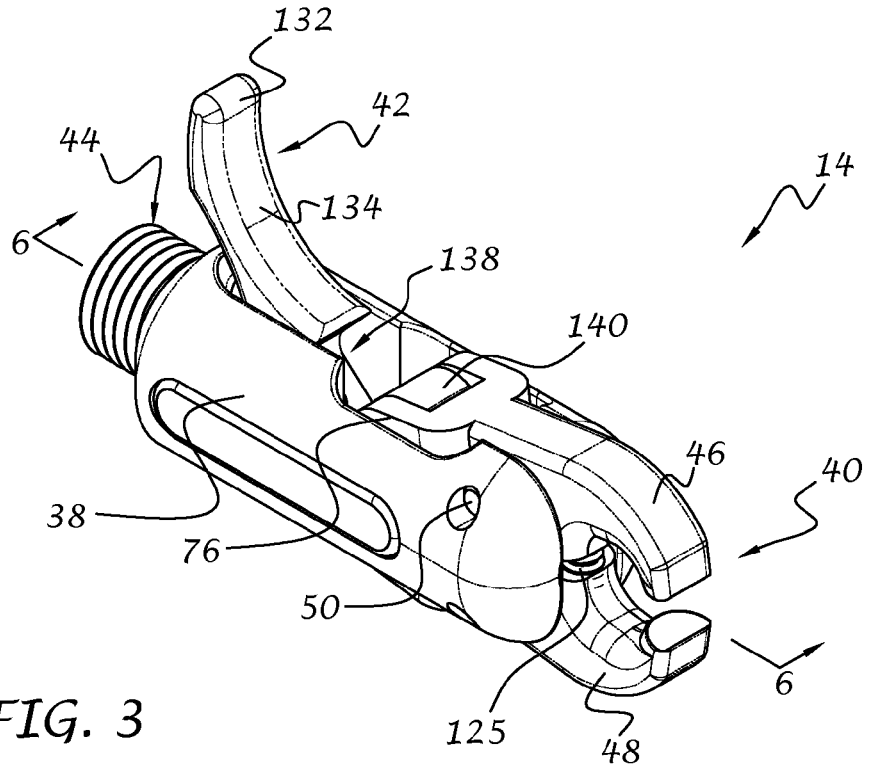
FIG. 3 is an isometric view of the bowstring release mechanism in the open position for receiving and releasing a bowstring.
Figure 4:
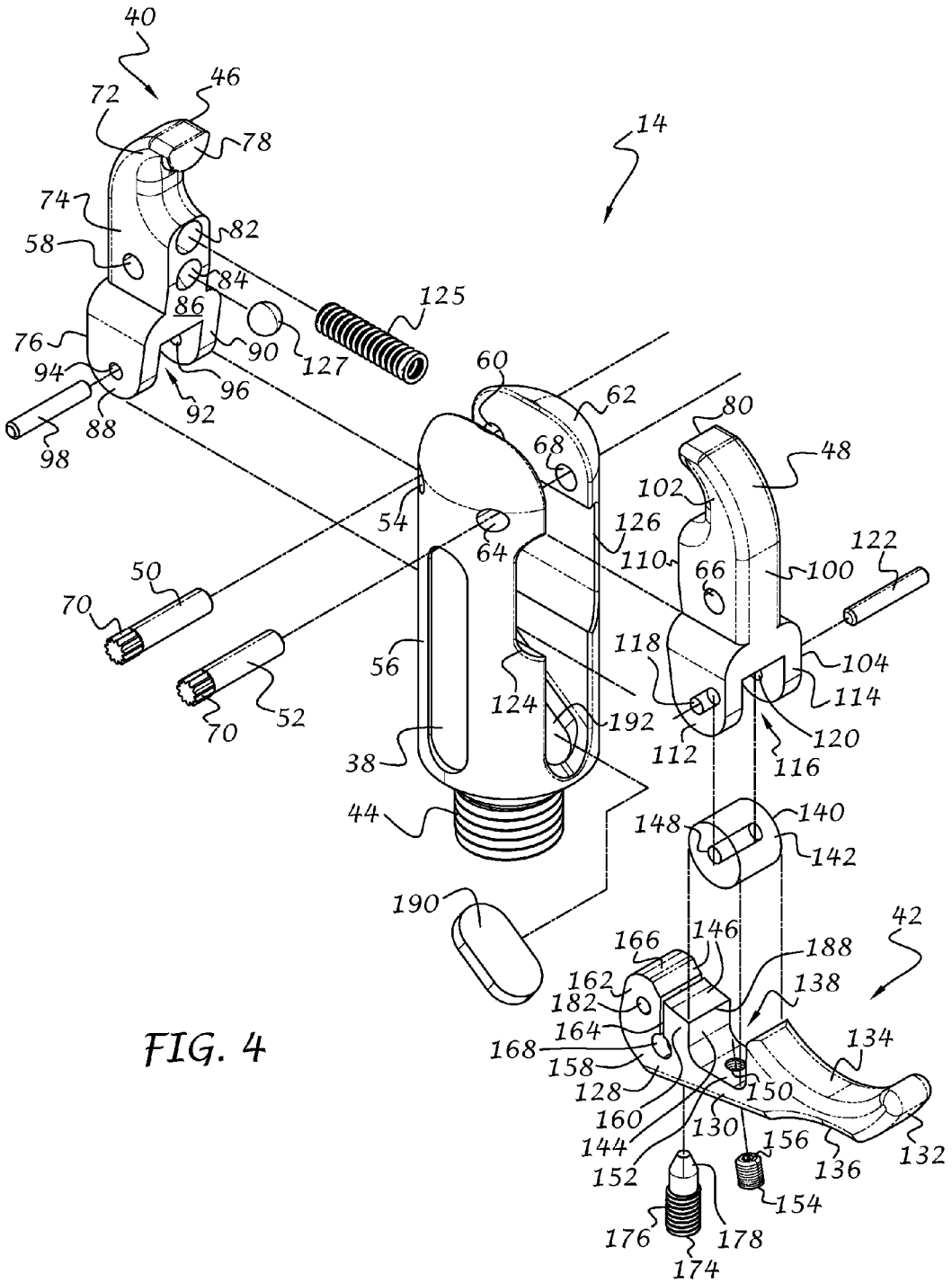
FIG. 4 is an exploded isometric view thereof.
Figure 5:
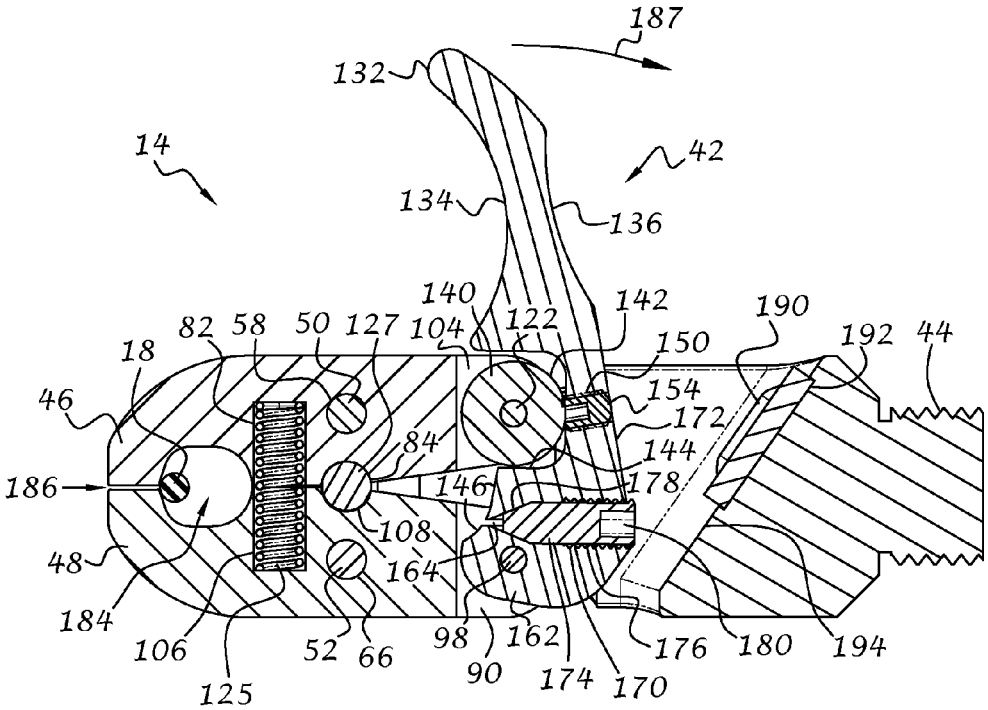
FIG. 5 is a sectional view of the bowstring release mechanism in the closed position taken along line 5-5 of FIG. 2.

The first jaw 46 preferably includes a main body portion 74, a hook portion 72 extending from the main body portion in one direction, and a bifurcated link portion 76 extending from the main body portion in an opposite direction. The hook portion 72 preferably curves in a 90-degree arc from the body portion and has a jaw face 78 that faces the jaw face 80 of the second jaw 48 when the release mechanism 14 is in the closed position, as shown in FIGS. 1, 2 and 5. The main body portion 74 preferably includes the opening 58 which extends laterally therethrough, and a cylindrically-shaped bore 82 and a semi-spherically-shaped bore 84 formed longitudinally in the main body portion 74 from a lateral face 86 thereof. The bifurcated link portion 76 preferably includes a first leg 88 and a second leg 90 that extend from the main body portion 74 with a gap 92 located therebetween. Openings 94 and 96 extend through the legs 88 and 90, respectively, for receiving a third pivot pin 98.

The second jaw 48 also preferably includes a main body portion 100, a hook portion 102 extending from the main body portion in one direction, and a bifurcated link portion 104 extending from the main body portion in an opposite direction. The hook portion 102 preferably curves in a 90-degree arc from the body portion and has a jaw face 80 that faces the jaw face 78 of the first jaw 46 when the release mechanism 14 is in the closed position. The main body portion 100 preferably includes the opening 66 which extends laterally therethrough, and a cylindrically-shaped bore 106 (FIG. 5) and a semi-spherically-shaped bore 108 formed longitudinally in the main body portion 100 from a lateral face 110 thereof. The bifurcated link portion 104 preferably includes a first leg 112 and a second leg 114 that extend from the main body portion 100 with a gap 116 located therebetween. Openings 118 and 120 extend through the legs 112 and 114, respectively, for receiving a fourth pivot pin 122. Grooves 124 and 126 are respectively formed in the walls 56 and 62 of the housing 38. The main body portions 74 and 100 of their respective jaws 46 and 48 are located in the grooves 124 and 126.

A compression spring 125 is received in the cylindrically-shaped bores 82 and 106 of the first and second jaws 46 and 48, respectively, so that the jaws can quickly separate when the trigger section 42 is actuated. A spherically-shaped bearing 127 is received in the spherically-shaped bores 84 and 108 of the first and second jaws 46 and 48, respectively, and serves as a mutual pivot connection to limit the lateral movement of the jaws.

The trigger section 42 preferably includes an adjustment portion 128, a seat portion 130, and a lever portion 132. The lever portion is adapted to be manipulated by a finger or thumb of the user to move the jaws between their open and closed positions and, to that end, preferably includes a first curved segment 134 for engagement with a finger or thumb when pulling the trigger section 42 in a direction to open the jaws and a second curved segment 136 on an opposite side of the lever portion 132 for engagement with a finger or thumb when pushing the trigger section in an opposite direction to close the jaws. It will be understood that the lever portion 132 can be of any desired shape without departing from the spirit and scope of the invention.

The seat portion 130 is located adjacent to the lever portion 132 and includes a channel 138 for receiving a sear roller 140. The sear roller 140 is preferably cylindrical in shape and has an outer bearing surface 142 that rides along a side wall or first sear surface 144 associated with the channel 138 and a second sear surface 146 associated with the adjustment portion 128 as the trigger section 42 is rotated between the jaw closed position shown in FIG. 5 and the jaw open position shown in FIG. 6. The sear roller 140 also includes a central bore 148 for receiving the fourth pivot pin 122 so that the roller is rotatably mounted thereon between the first leg 112 and second leg 114 of the bifurcated link portion 104. A threaded opening 150 is preferably formed in the bottom wall 152 of the seat portion 130. An adjustment member or screw 154 is located in the threaded opening 150 and includes an upper surface 156 that can engage the sear roller 140 for adjusting the position of the sear roller with respect to the sear surfaces 144 and 146. In this manner, the sensitivity of the trigger section 42 can be adjusted by turning the screw 154 in or out so that the trigger is respectively easier or harder to actuate, to thereby accommodate the individual preferences of different users.

The adjustment portion 128 of the trigger section 42 preferably includes a bifurcated body 158 with a first leg 160 and a second leg 162 separated by a slot 164 that extends into the body 158 from a top surface 166 thereof. The slot 164 terminates at a circular aperture 168 that extends transversely through the body 158. In this manner, the legs 160 and 162 are biased toward each other. A threaded opening 170 (FIGS. 5 and 6) is formed in the body 158 and extends from a bottom surface 172 thereof to the circular aperture 168. An adjustment member 174 has a threaded section 176 that engages the threaded opening 170 and a wedge section 178 that engages the slot 164. A depression 180 is formed in the adjustment member 174 for receiving a tool or the like so that the adjustment member 174 can be rotated toward and away from the slot 164. To that end, the wedge section 178 is preferably of frustoconical shape. However, it will be understood that the wedge section 178 can be of any suitable shape without departing from the spirit and scope of the invention, so long as the wedge section serves to widen the slot as it moves further into the slot. An opening 182 extends transversely through the second leg 162 for receiving the third pivot pin 98 so that the trigger section 42 is rotatably mounted thereon between the first leg 88 and second leg 90 of the bifurcated link portion 76.

Figure 6:
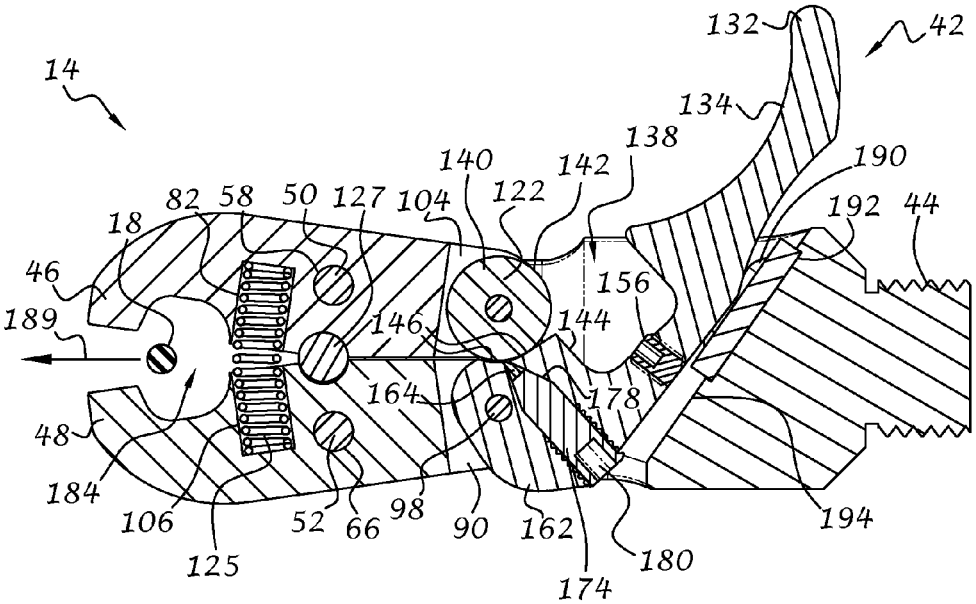
FIG. 6 is a sectional view of the bowstring release mechanism in the open position taken along line 6-6 of FIG. 3.

In operation, and with particular reference to FIGS. 5 and 6, the bowstring 18 is located in a space 184 created by the closed jaws (FIG. 5) of the release mechanism 14. A small gap or slit 186 is preferably formed between the jaw faces 78 and 80 when the jaws are in the closed position. It will be understood that the "gap" or "slit" may vary from completely closed where the jaw faces 78 and 80 are in direct contact with each other, to a position where the jaw faces are separated by a distance, which may vary. Due to tolerance limitations and assembly variations during manufacturing, as well as wear that may occur over time when in use, the gap 186 or a portion thereof may vary from mechanism to mechanism. When manufacturing dimensions vary by larger amounts than desired, a cumulative effect occurs where the jaws may fail to close properly and thus fail to properly hold the bowstring 18, especially when substantial forces are applied against the jaws when the user is in an aiming stance with the bow fully drawn. Accordingly, the present invention advantageously enables the manufacturer and/or the end user to adjust the gap or slit 186 so that the jaws 46 and 48 are at the proper position to retain the bowstring when substantial forces are present. In order to reduce the gap 186, the adjustment member 174 is rotated in a first direction, such as clockwise, to move the wedge section 178 further into the slot 164 to thereby cause the slot to expand, which ultimately moves the jaws 46 and 48 closer together to decrease the size of the gap 186. Likewise, in order to increase the gap 186, the adjustment member 174 is rotated in a second direction opposite the first direction, such as counter-clockwise, to move the wedge section 178 further out of the slot 164 to thereby cause the slot to contract, which ultimately moves the jaws 46 and 48 further apart to increase the size of the gap 186. In this manner, deviations in manufacturing dimensions and assembly, and increases in the gap size due to wear, can be precisely controlled without the need for specifying excessively narrow tolerances (which greatly increases manufacturing costs) or disposing of the release mechanism 14 in the event that the size of the gap 186 is not within an acceptable range. Accordingly, a substantial amount of material cost, labor, and unnecessary disposal of mechanisms that would otherwise be out of spec are eliminated by the adjustment capability of the present invention.

In order to separate the jaws 46 and 48 during use, the trigger section 42 is pulled or rotated in a direction as noted by arrow 187 in FIG. 5, thereby causing the roller 140 to ride along the first sear surface 144, cross the sear edge 188 (the over-center position) between the first and second sear surfaces, and rest on the second sear surface 146, as shown in FIG. 6. As the roller crosses the over-center position, the jaws 46 and 48 quickly snap open under biasing force from the compression spring 125 about the bearing 127 to release the bowstring 18 in a direction as represented by arrow 189. In order to close the jaws 46 and 48, the trigger section 42 is rotated in the opposite direction until the roller 140 passes the sear edge 188 to thereby cause the jaws to snap closed. With this arrangement, the jaws will not open until released by the trigger section 42. A resilient, impact-absorbing pad 190 can be positioned in a depression 192 (FIG. 4) formed in an inner surface 194 of the housing 38 for cushioning the trigger section 42 when the jaws are moved toward the open position. However, it will be understood that the pad 190 and associated depression can be eliminated without departing from the spirit and scope of the invention.

Referring now to FIGS. 7-11, a release mechanism 200 in accordance with a further embodiment of the invention is illustrated. The release mechanism 200 preferably includes a housing 202, a jaw section 204 extending forwardly therefrom, a trigger section 206 positioned in the housing rearwardly of the jaw section and operable to manipulate the opening and closing of the jaw section, and a connecting section 208 that forms part of the housing and is located rearwardly of the trigger section for connection to an extension member 16 (FIG. 1) or the like.

As in the previous embodiment, the jaw section 204 preferably includes a first jaw 210 and second jaw 212 pivotally connected to the housing 202 via first and second pivot pins 214 and 216, respectively. The first pivot pin 214 extends through an opening 218 (FIG. 9) formed in a first wall 220 of the housing 202, an opening 222 formed in the first jaw 210, and an opening 224 formed in a second wall 226 of the housing 202. Likewise, the second pivot pin 216 extends through an opening 228 formed in the first wall 220 of the housing 202, an opening 230 formed in the second jaw 212, and an opening 232 formed in a second wall 226 of the housing 202. The pivot pins 214, 216 are preferably cylindrical in shape with grooved or fluted end portions 234 that are press-fit into their respective openings 218, 228 to prevent rotation of the pivot pins with respect to the housing. The openings 222 and 230 of the jaws 210 and 212, respectively, are preferably slightly larger in diameter than the pivot pins so that the jaws freely pivot about their respective pins.

Figure 7:
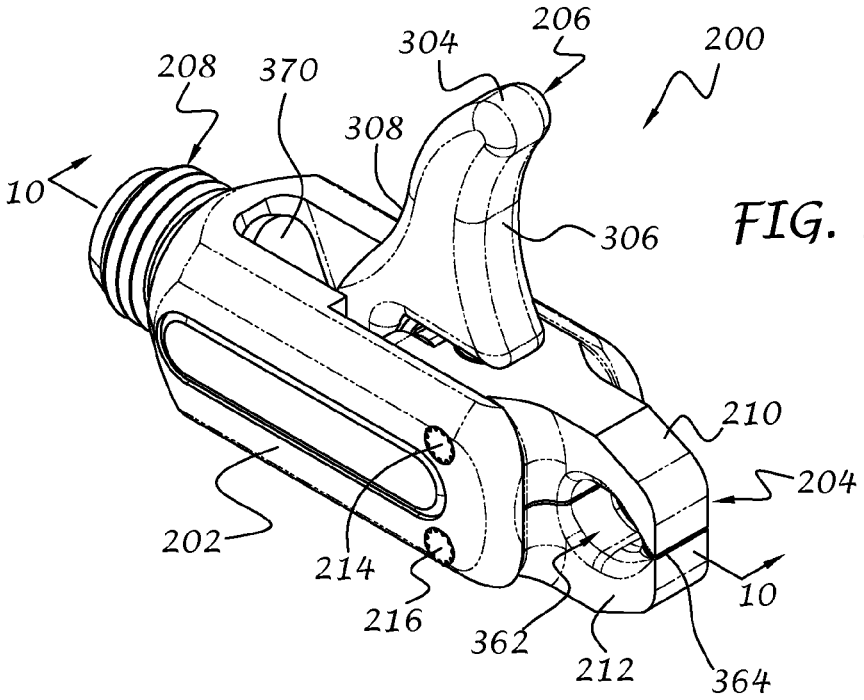
FIG. 7 is an isometric view of a bowstring release mechanism in accordance with a further embodiment of the present invention in the closed position for holding a bowstring.
Figure 8:
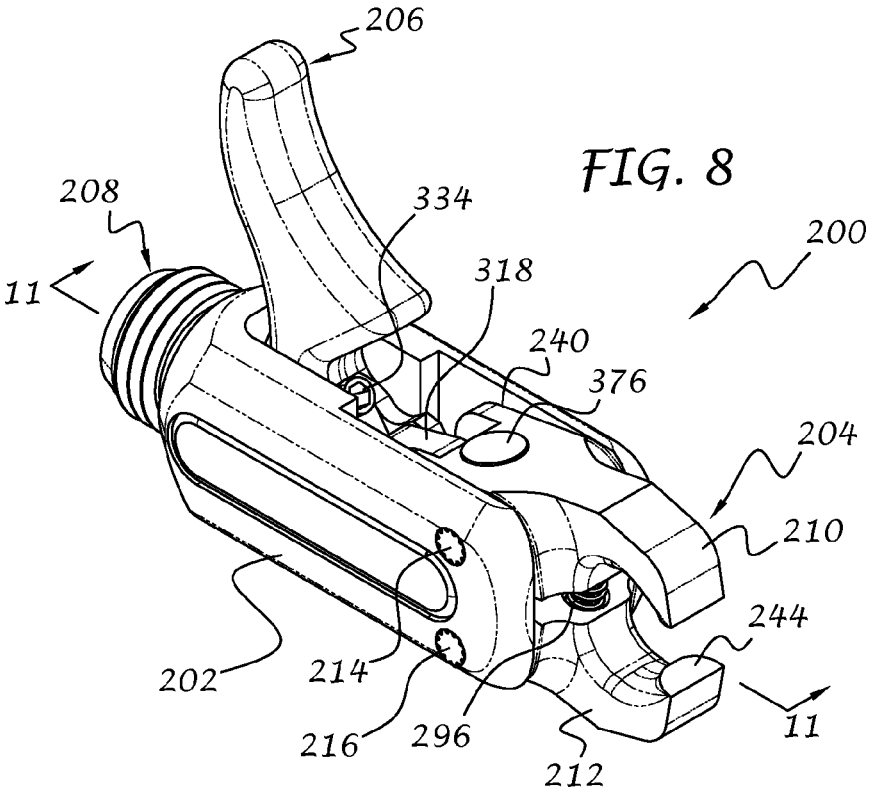
FIG. 8 is an isometric view of the bowstring release mechanism of FIG. 7 in the open position for receiving and releasing a bowstring.
Figure 9:
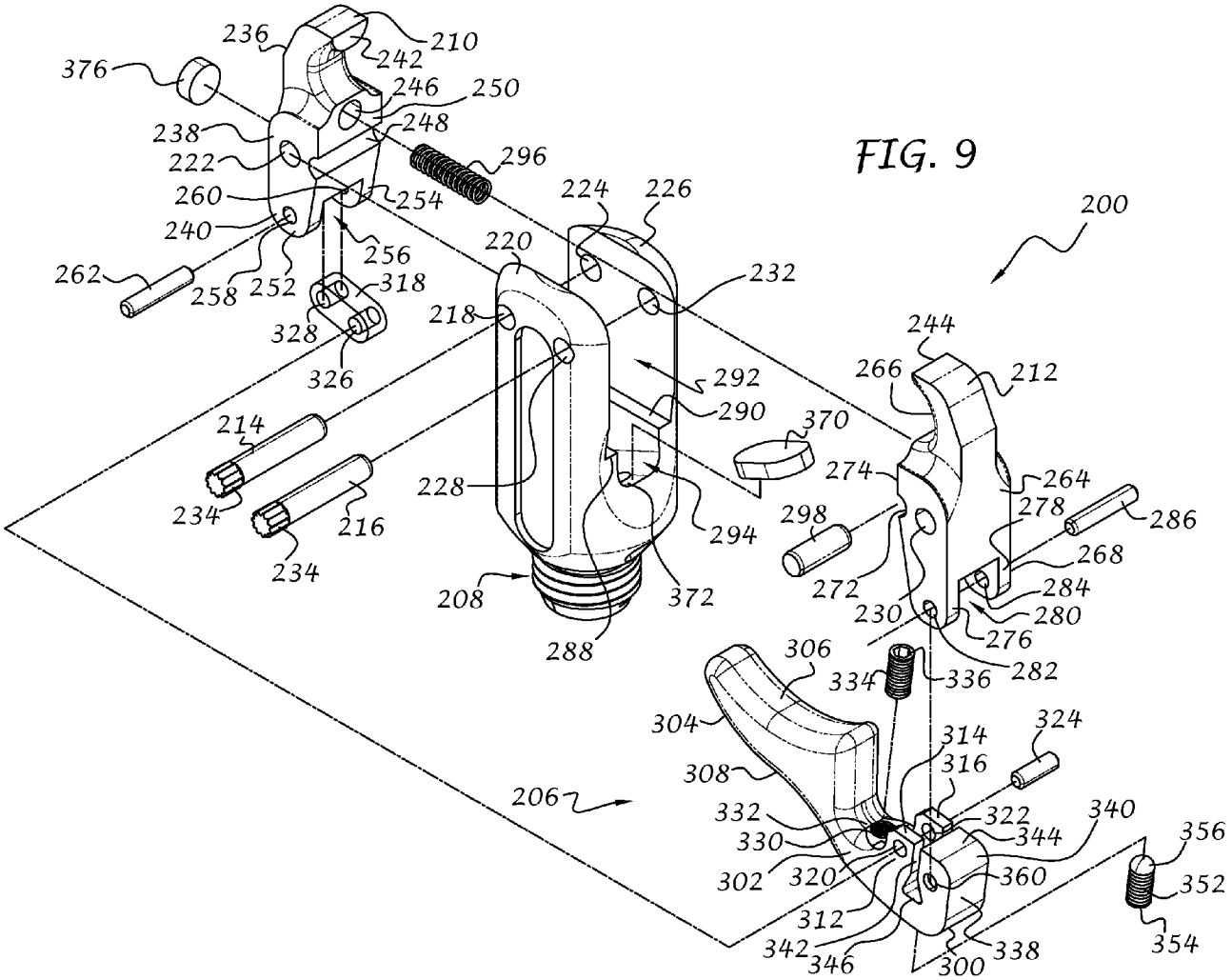
FIG. 9 is an exploded isometric view thereof.
Figure 10:
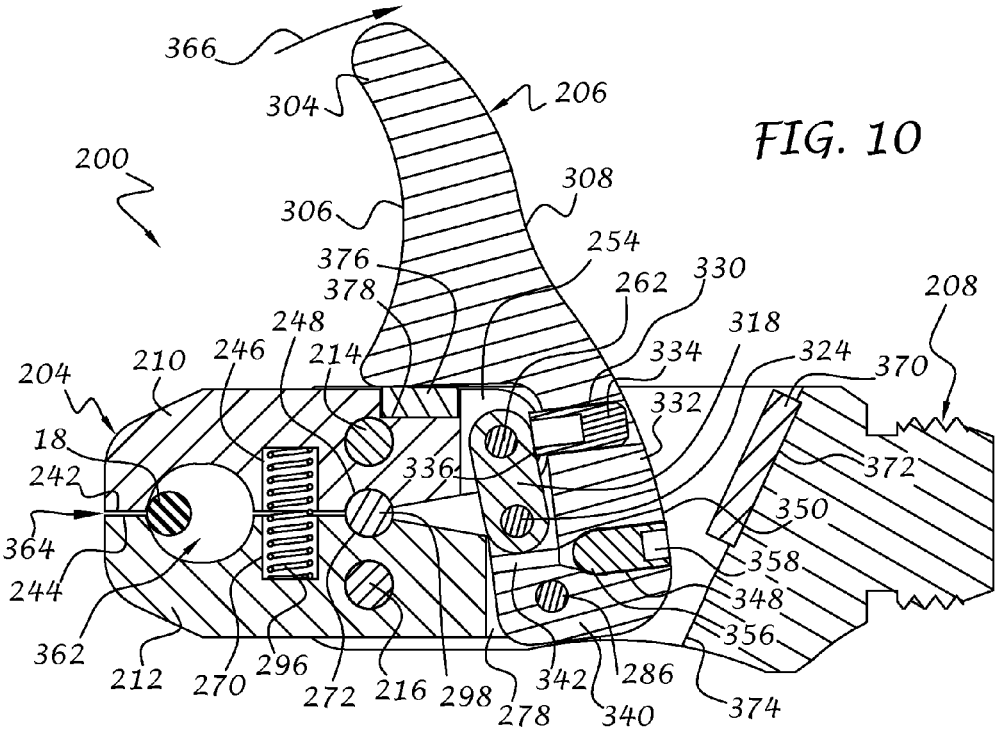
FIG. 10 is a sectional view of the bowstring release mechanism in the closed position taken along line 10-10 of FIG. 7.

The first jaw 210 preferably includes a main body portion 238, a hook portion 236 extending from the main body portion in one direction, and a bifurcated link portion 240 extending from the main body portion in an opposite direction. The hook portion 236 preferably curves in a 90-degree arc from the body portion and has a jaw face 242 that faces the jaw face 244 of the second jaw 212 when the release mechanism 200 is in the closed position, as shown in FIGS. 7 and 10. The main body portion 238 preferably includes the opening 222 which extends laterally therethrough, and a cylindrically-shaped bore 246 and a semi-cylindrically-shaped groove 248 formed in a lateral face 250 of the main body portion 238. The bifurcated link portion 240 preferably includes a first leg 252 and a second leg 254 that extend from the main body portion 238 with a gap 256 located therebetween. Openings 258 and 260 extend through the legs 252 and 254, respectively, for receiving a third pivot pin 262.

The second jaw 212 also preferably includes a main body portion 264, a hook portion 266 extending from the main body portion in one direction, and a bifurcated link portion 268 extending from the main body portion in an opposite direction. The hook portion 266 preferably curves in a 90-degree arc from the body portion and has a jaw face 244 that faces the jaw face 242 of the first jaw 210 when the release mechanism 200 is in the closed position. The main body portion 264 preferably includes the opening 230 which extends laterally therethrough, and a cylindrically-shaped bore 270 and a semi-cylindrically-shaped groove 272 (FIG. 10) formed in a lateral face 274 of the main body portion 264. The bifurcated link portion 268 preferably includes a first leg 276 and a second leg 278 that extend from the main body portion 264 with a gap 280 located therebetween. Openings 282 and 284 extend through the legs 276 and 278, respectively, for receiving a fourth pivot pin 286.

Steps 288 and 290 are respectively formed in the walls 220 and 226 of the housing 202 to form a first space 292 and a narrower second space 294. The main body portions 238 and 264 of their respective jaws 210 and 212 are located in the first space 292 while a portion of the trigger section 206 is located in the second space 294.

A compression spring 296 is received in the cylindrically-shaped bores 246 and 270 of the first and second jaws 210 and 212, respectively, so that the jaws can quickly separate when the trigger section 206 is actuated. A cylindrically-shaped bearing 298 is received in the cylindrically-shaped grooves 248 and 272 of the first and second jaws 210 and 212, respectively, and serves as a mutual pivot connection to limit the lateral movement of the jaws.

The trigger section 206 preferably includes an adjustment portion 300, a link portion 302, and a lever portion 304. The lever portion preferably includes a first curved segment 306 for engagement with a finger or thumb when pulling the trigger section 206 in one direction to open the jaws and a second curved segment 308 on an opposite side of the lever portion 206 for engagement with a finger or thumb when pushing the trigger section in an opposite direction to close the jaws. As in the previous embodiment, it will be understood that the lever portion 304 can be of any desired shape without departing from the spirit and scope of the invention.

The link portion 302 preferably includes a link bracket 312 and a channel 310 located between the lever portion 304 and the link bracket 312. The link bracket 312 includes a first leg 314 and a second leg 316 with a gap formed therebetween for receiving a link arm 318. To that end, openings 320 and 322 are respectively formed in the legs 314 and 316 for receiving a fifth pivot pin 324. The link arm 318 includes a first opening 326 through which the pivot pin 324 extends for pivotally mounting the link arm 318 to the trigger section 206. The link arm 318 also includes a second opening 328 through which the third pivot pin extends when the associated end of the link arm 318 is positioned in the gap 256 of the bifurcated link portion 240 of the first jaw 210. The link arm 318 is thus rotatable with respect to the first jaw 210 and the trigger section 206 to thereby pivotally link the first jaw and trigger section together. A threaded opening 330 is preferably formed in the bottom wall 332 of the channel 310. An adjustment member or screw 334 is located in the threaded opening 330 and includes an upper surface 336 (FIG. 10) that engages the link arm 318 in the vicinity of the third pivot pin 262 for adjusting the position of the lever portion 304 with respect to the link arm 318. In this manner, the sensitivity of the trigger section 206 can be adjusted by turning the screw 334 in or out so that the trigger is respectively easier or harder to actuate, to thereby accommodate the individual preferences of different users.

The adjustment portion 300 of the trigger section 206 preferably includes a bifurcated body 338 with the link bracket 312 functioning as a first leg, a second leg 340, and a slot 342 located between the first and second legs. The slot 342 extends into the body 338 from a top surface 344 thereof. The slot 342 preferably terminates at a dove-shaped aperture 346 that extends transversely through the body 338. In this manner, the legs 312 and 340 are biased toward each other. A threaded opening 348 (FIGS. 10 and 11) is formed in the body 338 and extends from a bottom surface 350 thereof to the dovetail-shaped aperture 346. An adjustment member 352 has a threaded section 354 that engages the threaded opening 348 and a wedge section 356 that engages the walls of the dovetail-shaped aperture 346. A depression 358 is formed in the adjustment member 352 for receiving a tool or the like (not shown) so that the adjustment member 352 can be rotated toward and away from the slot 342. To that end, the wedge section 356 is preferably of semi-spherical shape. However, it will be understood that the wedge section 356 can be of any suitable shape without departing from the spirit and scope of the invention, so long as the wedge section serves to widen the slot as it moves toward the slot. An opening 360 extends transversely through the second leg 340 for receiving the fourth pivot pin 286 so that the trigger section 206 is rotatably mounted thereon between the first leg 276 and second leg 278 of the bifurcated link portion 268.

Figure 11:
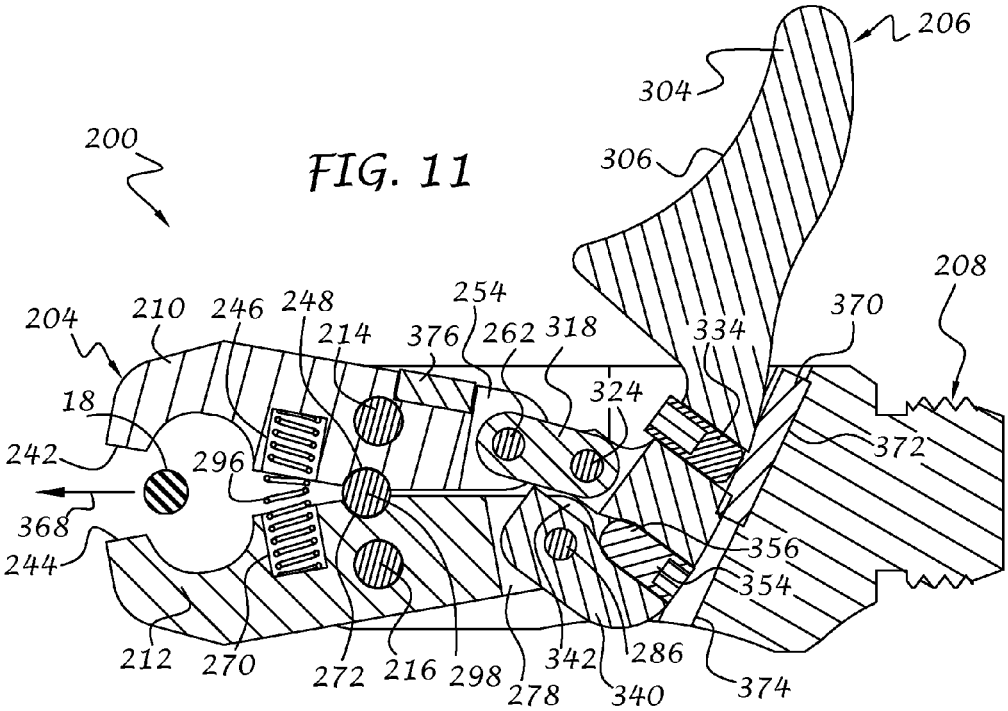
FIG. 11 is a sectional view of the bowstring release mechanism in the open position taken along line 11-11 of FIG. 8.

In operation, and with particular reference to FIGS. 10 and 11, the bowstring 18 is located in a space 362 between the closed jaws (FIG. 10) of the release mechanism 200. As in the previous embodiment, a small gap or slit 364 is preferably formed between the jaw faces 242 and 244. In order to reduce the gap 364, the adjustment member 352 is rotated in a first direction, such as clockwise, to move the wedge section 356 further toward the slot 342 to thereby cause the slot to expand which ultimately moves the jaws 210 and 212 closer together to decrease the size of the gap 364. Likewise, in order to increase the gap 364, the adjustment member 352 is rotated in a second direction opposite the first direction, such as counter-clockwise, to move the wedge section 356 away from the slot 342 to thereby cause the slot to contract which ultimately moves the jaws 210 and 212 farther apart to increase the size of the gap 364. The widening and narrowing of the slot 342 changes the relationship between the pivot pin 286 and the over-center position of the link arm 318. In this manner, deviations in manufacturing dimensions and assembly, and increases in the gap size due to wear, can be precisely controlled without the need for specifying excessively narrow tolerances (which greatly increases manufacturing costs) or disposing of the release mechanism 200 in the event that the size of the gap 364 is not within an acceptable range. Accordingly, a substantial amount of material cost, labor, and unnecessary disposal of mechanisms that would otherwise be out of spec are eliminated by the adjustment capability of the present invention.

In order to separate the jaws 210 and 214 during use, the trigger section 206 is pulled or rotated in a direction as noted by arrow 366 in FIG. 10, thereby causing the link arm 318 to move past an over-center position and causing the jaws 210 and 212 to quickly snap open under biasing force of the compression spring 296 about the pivot joint defined by the bearing 298 to release the bowstring 18 in a direction as represented by arrow 368. In order to close the jaws 210 and 212, the trigger section 206 is rotated in the opposite direction until the link arm 318 passes the over-center position to thereby cause the jaws to snap closed. With this arrangement, the jaws will not open until released by the trigger section 206. A resilient, impact-absorbing pad 370 can be positioned in a depression 372 (FIG. 10) formed in an inner surface 374 of the housing 202 for cushioning the trigger section 206 when the jaws are moved to the open position. A resilient, impact-absorbing pad 376 is also located in a depression 378 formed in the first jaw 210 to cushion the trigger section 206 when the jaws 210, 212 are in the closed position. However, it will be understood that one or more of the pads 190, 376 and their associated depressions can be eliminated without departing from the spirit and scope of the invention.

Referring now to FIGS. 12-16, a release mechanism 380 in accordance with a further embodiment of the invention is illustrated. The release mechanism 380 preferably includes a housing 382, a jaw section 384 extending forwardly therefrom, a trigger section 386 positioned in the housing rearwardly of the jaw section and operable to manipulate the opening and closing of the jaw section, and a connecting section 388 that forms part of the housing and is located rearwardly of the trigger section for connection to an extension member 16 (FIG. 1) or the like.

The jaw section 384 preferably includes a first jaw 390 and second jaw 392 pivotally connected to the housing 382 via first and second pivot pins 394 and 396, respectively. The pivot pin 394 extends through an upper opening 398 (FIG. 14) formed in a first wall 400 of the housing 382, an opening 402 formed in the first jaw 390, and an upper opening 404 formed in a second wall 406 of the housing 382. Likewise, the pivot pin 396 extends through a lower opening 408 formed in the first wall 400 of the housing 382, an opening 410 formed in the second jaw 392, and a lower opening 412 formed in the second wall 406 of the housing 382. The pivot pins 394, 396 are preferably cylindrical in shape with grooved or fluted end portions 414 that are press-fit into their respective openings 398, 408 to prevent rotation of the pivot pins with respect to the housing. The openings 402 and 410 of the jaws 390 and 392, respectively, are preferably slightly larger in diameter than the pivot pins so that the jaws freely pivot about their respective pins.

Figure 12:
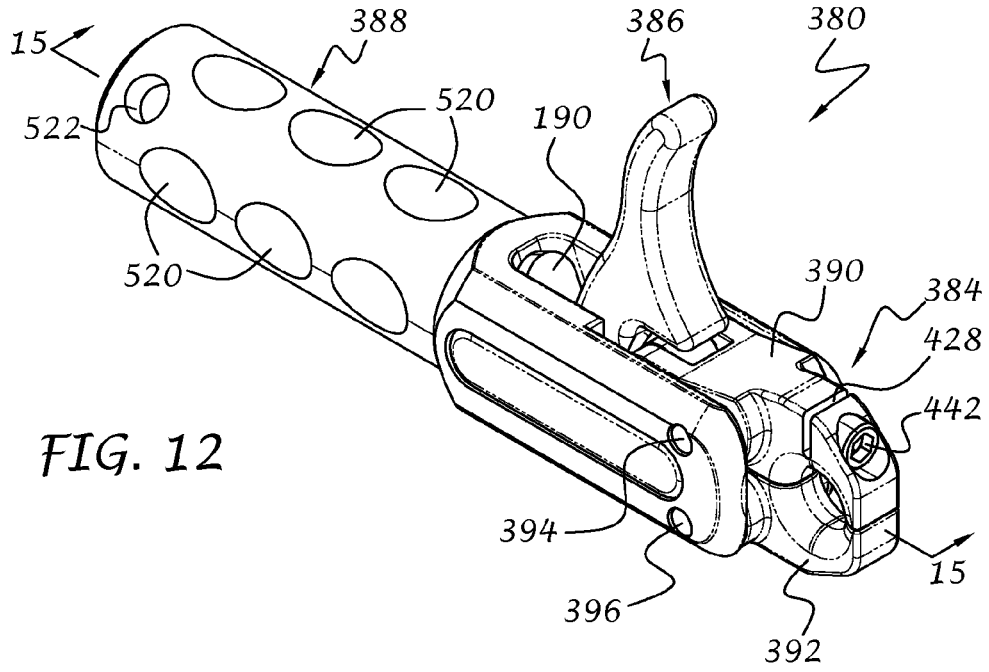
FIG. 12 is an isometric view of a bowstring release mechanism in accordance with a further embodiment of the present invention in the closed position for holding a bowstring.
Figure 13:
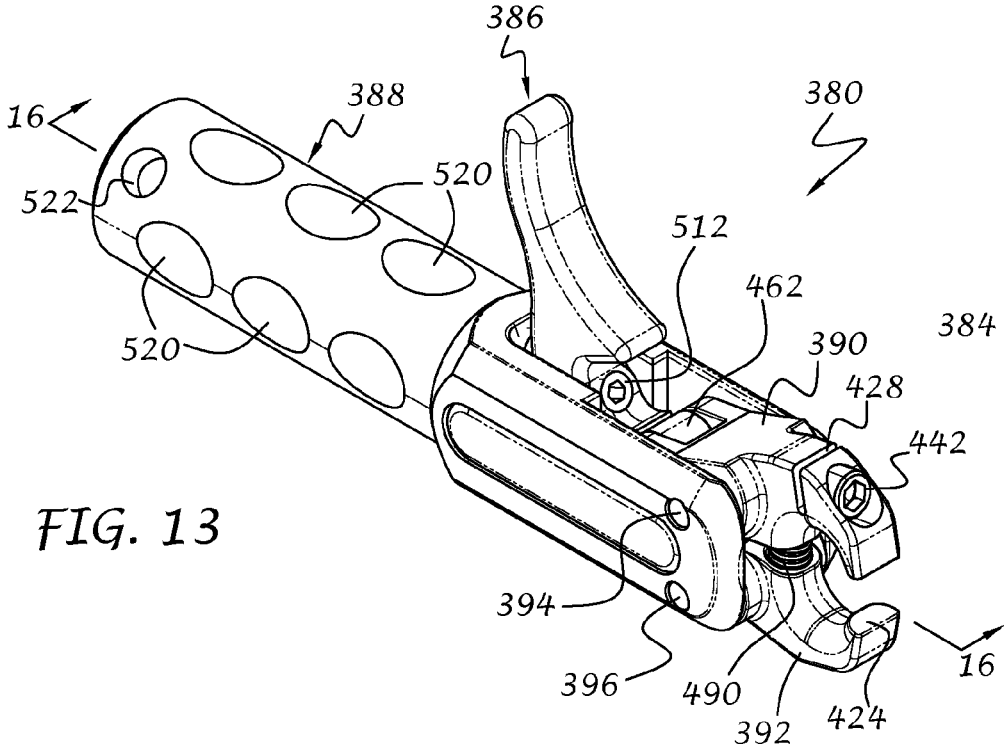
FIG. 13 is an isometric view of the bowstring release mechanism of FIG. 12 in the open position for receiving and releasing a bowstring.
Figure 14:
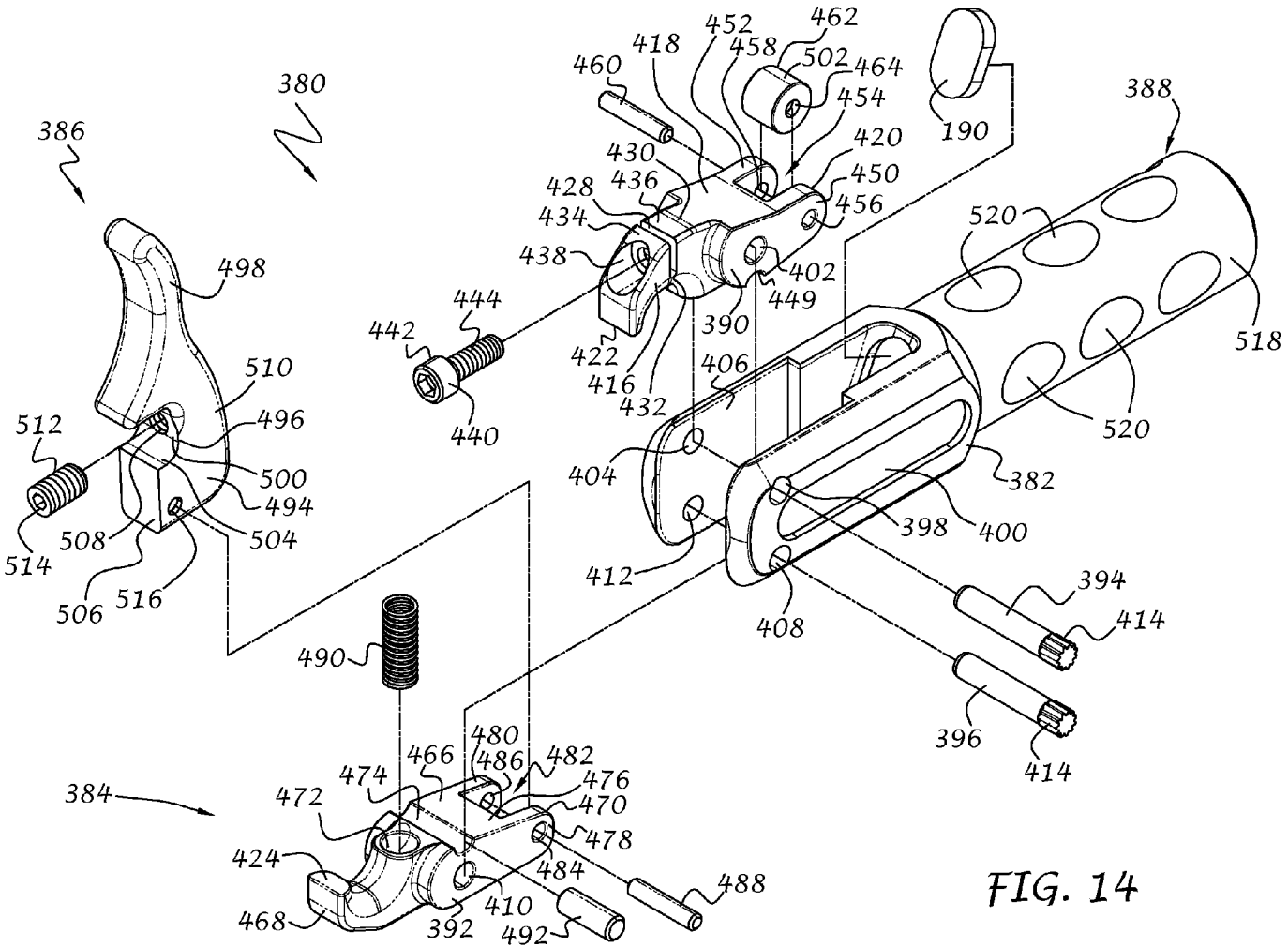
FIG. 14 is an exploded isometric view thereof.
Figure 15:
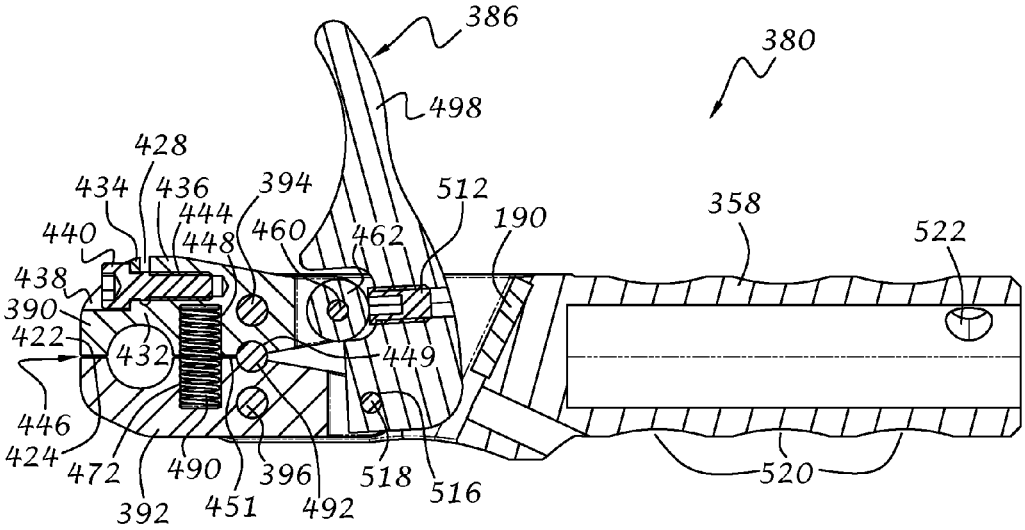
FIG. 15 is a sectional view of the bowstring release mechanism in the closed position taken along line 15-15 of FIG. 12.
Figure 16:
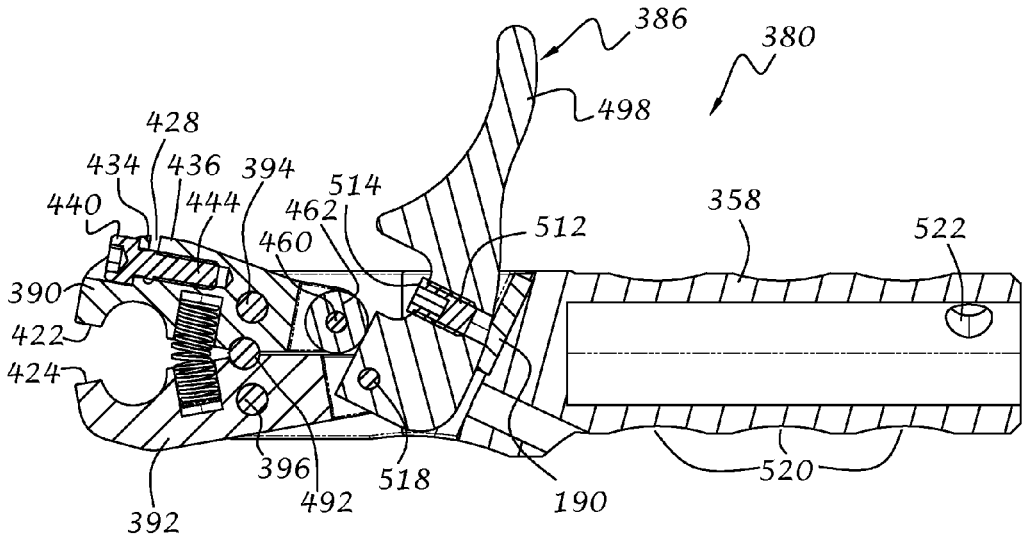
FIG. 16 is a sectional view of the bowstring release mechanism in the open position taken along line 16-16 of FIG. 13.

The first jaw 390 preferably includes a main body portion 418 a hook portion 416 extending from the main body portion in one direction, and a bifurcated link portion 420 extending from the main body portion in an opposite direction. The hook portion 416 preferably curves in a 90-degree arc from the body portion and has a jaw face 422 that faces the jaw face 424 of the second jaw 392 when the release mechanism 380 is in the closed position, as shown in FIGS. 12 and 15.

An adjustment portion 426 is associated with the hook portion 416 and preferably includes a slot or gap 428 that extends into the body of the hook portion 416 from an upper surface 430 thereof to thereby form a lever arm 432 extending between a first adjustment portion 434 and a second adjustment portion 436. A countersunk opening 438 is formed in the first adjustment portion 434 for receiving the head 440 of a bolt 442 or other threaded fastener. A threaded opening 444 is also formed in the second adjustment portion 436 for receiving the threaded shaft 446 of the bolt 442. With this arrangement, the shaft 446 of the bolt 442 extends through and transverse to the slot 428. In operation, when it is desirous or expedient to widen a gap 446 (FIG. 15) between the jaw faces 422 and 424, the threaded fastener 442 is rotated in one direction, such as clockwise when the threads are right-handed, to pull the first adjustment portion 434 toward the second adjustment portion 436 thereby widening the gap 446. Conversely, when it is desirous or expedient to narrow the gap 446, the threaded fastener 4462 is rotated in the opposite direction to pull the first adjustment portion 434 away from the second adjustment portion 436 thereby narrowing the gap 446. Operation of the adjustment portion 426 in this manner is completely independent of trigger position. It will be understood that other means can be used for adjusting the relative position between the first and second adjustment portions without departing from the spirit and scope of the invention.

The main body portion 418 preferably includes the opening 402 which extends laterally therethrough, and a cylindrically-shaped bore 448 (FIG. 15) and a semi-cylindrically-shaped groove 449 formed in a lateral face 451 of the main body portion 238. formed longitudinally therein. The bifurcated link portion 420 preferably includes a first leg 450 and a second leg 452 that extend from the main body portion 418 with a gap 454 located therebetween. Openings 456 and 458 extend through the legs 450 and 452, respectively, for receiving a third pivot pin 460. As in the first embodiment, a sear roller 462 is positioned in the gap 454 and rotatable with respect to the legs 450 and 452 via the third pivot pin 460 that extends through a central bore 464 (FIG. 14) of the sear roller.

The second jaw 392 also preferably includes a main body portion 466, a hook portion 468 extending from the main body portion in one direction, and a bifurcated link portion 470 extending from the main body portion in an opposite direction. The hook portion 468 preferably curves in a 90-degree arc from the body portion and has a jaw face 424 that faces the jaw face 422 of the first jaw 390 when the release mechanism 380 in the closed position. The main body portion 466 preferably includes the opening 410 which extends laterally therethrough, and a cylindrically-shaped bore 472 (FIG. 14) and cylindrically-shaped groove 474 formed longitudinally in a lateral face 476 of the main body portion 466. The bifurcated link portion 470 preferably includes a first leg 478 and a second leg 480 that extend from the main body portion 466 with a gap 482 located therebetween. Openings 484 and 486 extend through the legs 478 and 480, respectively, for receiving a fourth pivot pin 488.

A compression spring 490 is received in the cylindrically-shaped bores 448 and 472 of the first and second jaws 390 and 392, respectively, so that the jaws can quickly separate when the trigger section 386 is actuated. A cylindrically-shaped bearing 492 is received in the cylindrically-shaped grooves 449 and 476 of the first and second jaws, respectively, and serves as a common pivot connection about which the jaws pivot during jaw movement between the open and closed positions.

The trigger section 386 preferably includes a pivot portion 494, a seat portion 496, and a lever portion 498. The lever portion is adapted to be manipulated by a finger or thumb of the user to move the jaws between their open and closed positions. The seat portion 496 is located adjacent to the lever portion 498 and includes a channel 500 for receiving the sear roller 462. The sear roller 462 preferably has an outer bearing surface 502 that rides along a side wall or first sear surface 504 associated with the channel 500 and a second sear surface 506 associated with the pivot portion 494 as the trigger section 386 is rotated between the jaw closed position shown in FIG. 15 and the jaw open position shown in FIG. 16. A threaded opening 508 is preferably formed in the bottom wall 510 of the seat portion 130. An adjustment member or screw 512 is located in the threaded opening 508 and includes an outer surface 514 that can engage the sear roller 462 for adjusting the position of the sear roller with respect to the sear surfaces 504 and 506. In this manner, the sensitivity of the trigger section 386 can be adjusted by turning the screw 512 in or out so that the trigger is respectively easier or harder to actuate, to thereby accommodate the individual preferences of different users. An opening 516 extends transversely through the pivot portion 494 for receiving the fourth pivot pin 488 so that the trigger section 386 is rotatably mounted thereon between the first leg 478 and second leg 480 of the bifurcated link portion 470.

The connecting section 388 preferably includes a hollow tubular member 518 with dimples or depressions 520 located on an outer surface thereof and an opening 522 extending through the hollow tubular member so that the connecting section can be removably mounted to a wrist strap 12 (FIG. 1) or the like in a known manner. It will be understood that the connecting section can be configured in a variety of different shapes and connecting configurations without departing from the spirit and scope of the invention.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. By way of example, although both jaws of the preferred embodiments of the invention are movable when the trigger is actuated, it will be understood that one of the jaws can remain stationary without departing from the spirit and scope of the invention. It will be understood, therefore, that the present invention is not limited to the particular embodiments disclosed, but also covers modifications within the spirit and scope of the invention as defined by the appended claims.

What is claimed is:

1. A bowstring release device comprising:

a housing;

a first jaw associated with the housing, the first jaw having a first hook portion with a first face;

a second jaw associated with the housing, the second jaw having a second hook portion with a second face disposed in juxtaposition with the first face;

at least one of the jaws being movable with respect to the other of the jaws between a closed position wherein the first and second hook portions form an enclosed space for receiving and retaining a bowstring, and an open position to thereby open the enclosed space and release the bowstring therefrom;

a trigger section operatively associated with the housing and the at least one jaw for moving the at least one jaw between the closed and open positions;

a first adjustment mechanism operatively associated with one of the jaws for adjusting a gap between the first and second faces when in the closed position to thereby ensure retention of the bowstring within the enclosed space despite variations that may occur in the gap during manufacture or use; and a second adjustment mechanism for adjusting a pull sensitivity of the trigger section;

wherein the first adjustment mechanism forms part of one of the first and second jaws and comprises a slot extending into a body of the one jaw to thereby form a first adjustment jaw portion and a second adjustment jaw portion with a lever arm extending therebetween; and a fastener extends between the first and second adjustment jaw portions and being adjustable for increasing and decreasing a width of the slot to thereby decrease and increase, respectively, the gap between the first and second faces.

2. A bowstring release device according to claim 1, wherein the second adjustment mechanism is movable with respect to the trigger section to thereby vary an angular position of the trigger section with respect to the housing when the release device is in the closed position.

3. A bowstring release device comprising:

a housing;

a first jaw associated with the housing, the first jaw having a first face;

a second jaw associated with the housing, the second jaw having a second face disposed in juxtaposition with the first face;

at least one of the jaws being movable with respect to the other of the jaws between closed and open positions for respectively retaining and releasing a bowstring;

a trigger section operatively associated with the housing and the at least one jaw for moving the at least one jaw between the closed and open positions;

a first adjustment mechanism operatively associated with one of the jaws for adjusting a gap between the first and second faces;

a second adjustment mechanism for adjusting a pull sensitivity of the trigger section, the second adjustment mechanism being movable with respect to the trigger section to thereby vary an angular position of the trigger section with respect to the housing when the release device is in the closed position; wherein the first adjustment mechanism comprises:

a bifurcated body formed in the trigger section, the bifurcated body including a first leg and a second leg separated by a slot that extends into the body, with the first leg being pivotally connected to the at least one jaw; and an adjustment member adapted for movement toward and away from the slot to thereby vary a width of the slot and cause movement of the at least one jaw to thereby vary the gap between the first and second faces.

4. A bowstring release device according to claim 3, wherein the first adjustment mechanism further comprises:

a threaded opening formed in the bifurcated body; and the adjustment member having a threaded section for engaging the threaded opening, and a wedge section for engaging the slot;

wherein rotation of the adjustment member with respect to the threaded opening in one direction causes the wedge section to move toward the slot to thereby widen the slot and narrow the gap between the first and second faces, and rotation of the adjustment member in an opposite direction causes the wedge section to move away from the slot to thereby narrow the slot and widen the gap between the first and second faces.

5. A bowstring release device according to claim 4, wherein the first and second jaws are pivotally connected to the housing.

6. A bowstring release device according to claim 5, wherein the first leg is pivotally connected to first jaw, and the second leg is pivotally connected to housing.

7. A bowstring release device according to claim 6, wherein the trigger section comprises a channel with a first sear surface extending along the channel, a second sear surface extending traverse to the first sear surface, and a sear edge located between the first and second sear surfaces, and further comprising a sear roller located in the channel and pivotally connected to the second jaw, the sear roller being movably along the sear surfaces and the sear edge as the jaws move between the closed and open positions.

8. A bowstring release device according to claim 7, wherein the second adjustment member is movable toward and away from the sear roller in the channel to thereby change a position of the sear roller with respect to the first sear surface when the release mechanism is in the closed position.

9. A bowstring release device according to claim 5, and further comprising a link arm having first and second ends, the first end being pivotally connected to the first leg, and the second end being pivotally connected to the first jaw, with the second leg being pivotally connected to second jaw, such that movement of the trigger section in one direction causes the first and second jaws to separate and movement of the trigger section in an opposite direction causes the jaws to move towards each other.

10. A bowstring release device according to claim 9, wherein the adjustment member is generally movable toward and away from the second end of the link arm to thereby change a position of the link arm with respect to the trigger section when the release mechanism is in the closed position.

11. A bowstring release assembly comprising the bowstring release device of claim 1, and further comprising:

an adjustable wrist strap for fitting around a wrist of a user; and an extension member having a first end pivotally connected to the adjustable wrist strap and a second end connected to the bowstring release mechanism.

12. A bowstring release device comprising:

a housing;

a first jaw associated with the housing, the first jaw having a first face;

a second jaw associated with the housing, the second jaw having a second face disposed in juxtaposition with the first face;

at least one of the jaws being movable with respect to the other of the jaws between closed and open positions for respectively retaining and releasing a bowstring;

a trigger section operatively associated with the housing and the at least one jaw for moving the at least one jaw between the closed and open positions; and a first adjustment mechanism forming part of one of the first and second jaws for adjusting a gap between the first and second faces, and comprising:

a slot extending into a body of the one jaw to thereby form a first adjustment jaw portion and a second adjustment jaw portion with a lever arm extending therebetween; and a threaded fastener operably associated with the slot for increasing and decreasing a width of the slot to thereby decrease and increase, respectively, the gap between the first and second faces; with the fastener extending through the first adjustment jaw portion and engaging a threaded opening in the second adjustment jaw portion such that rotation of the fastener in one direction causes widening of the gap between the faces and rotation of the fastener in the opposite direction causes narrowing of the gap.

13. A bowstring release device comprising:

a housing;

a first jaw associated with the housing, the first jaw having a first face;

a second jaw associated with the housing, the second jaw having a second face disposed in juxtaposition with the first face;

at least one of the jaws being movable with respect to the other of the jaws between closed and open positions for respectively retaining and releasing a bowstring;

a trigger section operatively associated with the housing and the at least one jaw for moving the at least one jaw between the closed and open positions;

a first adjustment mechanism operatively associated with one of the jaws for adjusting a gap between the first and second faces, the first adjustment mechanism including a slot extending into a body of the one jaw to thereby form a first adjustment jaw portion and a second adjustment jaw portion with a lever arm extending therebetween; and a fastener extending between the first and second adjustment jaw portions and being adjustable for increasing and decreasing a width of the slot to thereby decrease and increase, respectively, the gap between the first and second faces, such that a size of the gap is selectively variable with the first adjustment mechanism to thereby enable precise adjustment of the gap between the first face of the first jaw and the second face of the second jaw when in the closed position and ensure the bowstring is retained with respect to the first and second jaws when in the closed position.

14. A bowstring release device according to claim 13, wherein the fastener comprises a threaded fastener, with the fastener extending through the first adjustment jaw portion and engaging a threaded opening in the second adjustment jaw portion such that rotation of the fastener in one direction causes widening of the gap between the faces and rotation of the fastener in the opposite direction causes narrowing of the gap between the faces.

15. A bowstring release device according to claim 13, and further comprising a second adjustment mechanism for adjusting a pull sensitivity of the trigger section independently of the first adjustment mechanism so that the gap between the faces and the pull force of the trigger are independently adjustable.

16. A bowstring release device according to claim 15, wherein the second adjustment mechanism is movable with respect to the trigger section to thereby vary an angular position of the trigger section with respect to the housing when the release device is in the closed position.

17. A bowstring release device according to claim 1, wherein the first adjustment mechanism and the second adjustment mechanism are spaced apart and independently operable to respectively control the gap and the pull sensitivity of the trigger section.

18. A bowstring release device comprising:

a housing;

a first jaw associated with the housing, the first jaw having a first hook portion with a first face;

a second jaw associated with the housing, the second jaw having a second hook portion with a second face disposed in juxtaposition with the first face;

at least one of the jaws being movable with respect to the other of the jaws between a closed position wherein the first and second hook portions form an enclosed space for receiving and retaining a bowstring, and an open position to thereby open the enclosed space and release the bowstring therefrom;

a trigger section operatively associated with the housing and the at least one jaw for moving the at least one jaw between the closed and open positions;

a first adjustment mechanism operatively associated with one of the jaws for adjusting a gap between the first and second faces when in the closed position to thereby ensure retention of the bowstring within the enclosed space despite variations that may occur in the gap during manufacture or use; and a second adjustment mechanism for adjusting a pull sensitivity of the trigger section;

wherein the first adjustment mechanism comprises:

a slot extending into one of the first and second jaws to thereby form a first adjustment jaw portion and a second adjustment jaw portion with a lever arm extending therebetween;

a first opening extending through the first adjustment jaw portion;

a second opening extending into the second adjustment jaw portion; and a fastener extending through the first opening, across the slot, and into the second opening, wherein movement of the fastener in a first direction causes the slot to widen, while movement of the fastener in a second direction opposite the first direction causes the slot to narrow, thereby moving one of the faces toward and away from the other of the faces.

* * * * *